US009775447B2

(12) United States Patent
Wiemer et al.

(10) Patent No.: US 9,775,447 B2
(45) Date of Patent: Oct. 3, 2017

(54) ILLUMINATED SHELVING

(71) Applicant: DCI Marketing, Inc., Milwaukee, WI (US)

(72) Inventors: Jim Wiemer, Fox Point, WI (US); Ryan Brobst, Grafton, WI (US); Jan Pergande, Cedarburg, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 0 days.

(21) Appl. No.: 14/657,815

(22) Filed: Mar. 13, 2015

(65) Prior Publication Data

US 2015/0182038 A1 Jul. 2, 2015

Related U.S. Application Data

(63) Continuation of application No. 13/415,138, filed on Mar. 8, 2012, now Pat. No. 8,979,296.

(Continued)

(51) Int. Cl.

| | |
|---|---|
| ***A47F 3/00*** | (2006.01) |
| ***A47F 11/10*** | (2006.01) |
| ***F21V 33/00*** | (2006.01) |
| ***A47F 5/10*** | (2006.01) |
| ***F21V 23/00*** | (2015.01) |
| ***F21V 23/06*** | (2006.01) |
| *F21W 131/301* | (2006.01) |
| *F21W 131/405* | (2006.01) |

(Continued)

(52) U.S. Cl.

CPC ..... *A47F 3/001* (2013.01); *A47F 5/103* (2013.01); *A47F 11/10* (2013.01); *F21V 23/001* (2013.01); *F21V 23/06* (2013.01); *F21V 33/0012* (2013.01); *F21W 2131/301* (2013.01); *F21W 2131/405* (2013.01); *F21Y 2103/10* (2016.08); *F21Y 2115/10* (2016.08)

(58) Field of Classification Search

CPC ..... A47F 3/001; A47F 5/103; A47F 11/10; F21V 23/001; F21V 23/06; F21V 33/0012; F21W 2131/301; F21W 2131/405; F21Y 2103/003; F21Y 2115/10; F21Y 2103/10

See application file for complete search history.

(56) References Cited

U.S. PATENT DOCUMENTS

| | | | |
|---|---|---|---|
| 2,510,944 | A | 6/1950 | Auerbach |
| 2,598,862 | A | 6/1952 | Tonn |

(Continued)

FOREIGN PATENT DOCUMENTS

| | | |
|---|---|---|
| DE | 20111800 | 11/2001 |
| DE | 102010050500 | 5/2012 |

(Continued)

OTHER PUBLICATIONS

International Search Report issued in International Application No. PCT/US12/28250, mailed Jul. 5, 2012, 1 page.

(Continued)

*Primary Examiner* — Stephen F Husar

(74) *Attorney, Agent, or Firm* — Fitch, Even, Tabin & Flannery LLP

(57) ABSTRACT

An illuminated shelving system is provided having light bars attached to the shelves. The light bars are electrically connected to a power strip that conducts electricity from a wall outlet to a plurality of light bars.

33 Claims, 4 Drawing Sheets

Related U.S. Application Data

(60) Provisional application No. 61/450,420, filed on Mar. 8, 2011.

(51) Int. Cl.
*F21Y 103/10* (2016.01)
*F21Y 115/10* (2016.01)

(56) References Cited

U.S. PATENT DOCUMENTS 2,674,723 A 4/1954 Hurlbut
2,755,452 A 7/1956 Rogie
3,605,064 A 9/1971 Contratto
3,622,938 A 11/1971 Ishida
3,886,348 A 5/1975 Jonathan
4,018,497 A 4/1977 Bulanchuk
4,042,291 A 8/1977 Moriyama
4,245,874 A 1/1981 Bishop
4,688,869 A 8/1987 Kelly
4,689,726 A 8/1987 Kretzschmar
4,747,025 A 5/1988 Barton
4,799,133 A 1/1989 Strzalko
4,886,462 A 12/1989 Fierro
4,973,796 A 11/1990 Dougherty
4,994,943 A 2/1991 Aspenwall
4,996,636 A 2/1991 Lovett
5,022,720 A 6/1991 Fevig
5,034,861 A 7/1991 Sklenak
5,072,343 A 12/1991 Buers
D330,090 S 10/1992 Walter
5,154,641 A 10/1992 McLaughlin
5,205,638 A 4/1993 Squitieri
5,334,037 A * 8/1994 Gabrius ..... H01R 25/142 439/118
5,348,485 A 9/1994 Briechle et al.
5,425,648 A 6/1995 Farham
5,476,396 A 12/1995 De Castro
5,639,258 A 6/1997 Clark
5,690,415 A 11/1997 Krehl
5,722,747 A 3/1998 Baron
5,722,847 A 3/1998 Haag
5,758,585 A 6/1998 Latchinian
5,816,696 A 10/1998 Beisler
5,902,034 A 5/1999 Santosuosso
5,902,150 A 5/1999 Sigl
5,915,824 A 6/1999 Straat
6,093,037 A 7/2000 Lin
6,179,434 B1 1/2001 Saraiji
6,196,648 B1 3/2001 Henriott
6,231,205 B1 * 5/2001 Slesinger ..... A47B 96/02 362/125
6,276,810 B1 8/2001 Vosshenrich
6,283,608 B1 9/2001 Straat
6,364,273 B1 4/2002 Otema
6,527,565 B1 3/2003 Johns
6,550,269 B2 4/2003 Rudick
6,558,017 B1 5/2003 Saraiji
6,599,145 B2 7/2003 Singh
D493,009 S 7/2004 Ken
6,808,407 B1 10/2004 Cannon
6,827,463 B2 12/2004 Chuang et al.
6,827,465 B2 12/2004 Shemitz
6,918,679 B2 7/2005 Wu
D521,286 S 5/2006 Colmenares
7,056,007 B2 6/2006 Chiu
7,121,675 B2 10/2006 Ter-Hovhannisian
7,163,305 B2 1/2007 Bienick
7,367,685 B2 5/2008 Moll
7,513,637 B2 4/2009 Kelly
7,574,822 B1 8/2009 Moore
7,597,448 B1 10/2009 Zarian
7,597,462 B2 10/2009 Misof
7,600,887 B2 10/2009 Sherman
7,614,350 B2 11/2009 Tuttle
7,614,761 B2 11/2009 Tanaka
7,726,831 B2 6/2010 Shibusawa
7,766,502 B2 8/2010 Tress
7,806,543 B2 10/2010 Swofford
7,824,055 B2 11/2010 Sherman
7,824,056 B2 11/2010 Madireddi
7,824,057 B2 11/2010 Shibusawa
7,871,176 B2 1/2011 Kelly
7,909,183 B2 3/2011 Oh
7,950,817 B2 5/2011 Zulim
7,954,979 B2 6/2011 Sommers
7,976,181 B2 7/2011 Kelly
8,002,441 B2 8/2011 Barkdoll
8,047,657 B2 11/2011 Ikeda
8,070,309 B2 12/2011 Otsuki
8,113,678 B2 2/2012 Babcock
8,136,956 B2 3/2012 Oketani
8,164,274 B2 4/2012 Johannes
8,172,096 B2 5/2012 Van De Steen
8,177,404 B2 5/2012 Weng
8,215,795 B2 7/2012 Pichel
8,490,424 B2 7/2013 Roche
8,545,045 B2 10/2013 Tress
8,562,167 B1 10/2013 Meier
8,602,230 B2 12/2013 Bergdoll
8,607,997 B2 12/2013 Bergdoll
8,616,757 B2 12/2013 Leadford
8,646,935 B2 2/2014 Karan
8,746,916 B2 6/2014 Oketani
8,858,013 B2 10/2014 Attey
8,864,334 B2 10/2014 Swafford
8,939,779 B1 1/2015 Lindblom
8,978,901 B2 3/2015 Hogeback
8,979,296 B2 3/2015 Wiemer
8,985,352 B2 3/2015 Bergdoll
9,022,637 B2 5/2015 Meyer
9,044,105 B2 6/2015 McClaughry
9,057,513 B2 6/2015 Lindblom
9,121,583 B2 9/2015 Takeuchi
9,149,130 B2 10/2015 Yuen
9,167,914 B2 10/2015 Rankin, VI
9,188,291 B2 11/2015 Cassidy
9,204,736 B2 12/2015 Lindblom
9,222,645 B2 12/2015 Breslow
9,228,735 B2 1/2016 Liu
9,239,136 B1 1/2016 Petersen
9,279,544 B1 3/2016 Dankelmann
9,364,100 B2 6/2016 Browning
9,384,684 B2 7/2016 Theisen
9,404,645 B1 8/2016 Feng
9,424,446 B2 8/2016 Baarman
9,456,704 B2 10/2016 Bhargava
9,509,110 B1 11/2016 Buck et al.
2002/0072323 A1 6/2002 Hakemann
2004/0050811 A1 3/2004 Leahy
2005/0173605 A1 8/2005 Villeneuve
2005/0254262 A1 11/2005 Chiu
2006/0067089 A1 3/2006 Hocquard
2006/0207778 A1 9/2006 Walter
2007/0022644 A1 2/2007 Lynch
2007/0290585 A1 12/2007 Moeller
2008/0083353 A1 4/2008 Tuttle
2008/0121146 A1 5/2008 Burns
2008/0151535 A1 6/2008 de Castris
2008/0277361 A1 11/2008 Primiano
2009/0279295 A1 11/2009 Van
2010/0087953 A1 4/2010 Garson
2010/0102685 A1 4/2010 Ward
2010/0103701 A1 4/2010 Bartlett
2011/0044030 A1 2/2011 Pichel
2011/0204009 A1 8/2011 Karan
2011/0215060 A1 9/2011 Niederhuefner
2011/0218889 A1 9/2011 Westberg
2011/0273867 A1 * 11/2011 Horst ..... A47B 96/021 362/133
2012/0230018 A1 9/2012 Wiemer
2013/0107501 A1 5/2013 Ewald
2013/0229789 A1 9/2013 Yoshida
2013/0286651 A1 10/2013 Takeuchi
2013/0299439 A1 11/2013 Sid

(56) References Cited

U.S. PATENT DOCUMENTS

| | | | |
|---|---|---|---|
| 2013/0337668 | A1 | 12/2013 | Ernest |
| 2014/0055978 | A1 | 2/2014 | Gantz |
| 2014/0055987 | A1 | 2/2014 | Lindblom |
| 2014/0104826 | A1 | 4/2014 | Bergdoll |
| 2014/0153279 | A1 | 6/2014 | Weyer |
| 2014/0224875 | A1 | 8/2014 | Slesinger |
| 2014/0254136 | A1 | 9/2014 | Oraw |
| 2014/0333541 | A1 | 11/2014 | Lee |
| 2015/0024615 | A1 | 1/2015 | Lindblom |
| 2015/0036326 | A1 | 2/2015 | Maciulewicz |
| 2015/0055328 | A1 | 2/2015 | Irii |
| 2015/0070928 | A1 | 3/2015 | Rau |
| 2015/0079823 | A1 | 3/2015 | Lindblom |
| 2015/0128398 | A1 | 5/2015 | Benlevi |
| 2015/0173529 | A1 | 6/2015 | Hester-Redmond |
| 2015/0241034 | A1 | 8/2015 | Dankelmann |
| 2015/0241035 | A1 | 8/2015 | Dankelmann |
| 2016/0061429 | A1 | 3/2016 | Waalkes |
| 2016/0091177 | A1 | 3/2016 | Houle |
| 2016/0097516 | A1 | 4/2016 | Howard |
| 2016/0104985 | A1 | 4/2016 | Ewing |
| 2016/0174733 | A1 | 6/2016 | Cinici |
| 2016/0213168 | A1 | 7/2016 | Nuttall |
| 2016/0313051 | A1 | 10/2016 | Alt |

FOREIGN PATENT DOCUMENTS

| | | |
|---|---|---|
| EP | 0683998 | 11/1995 |
| EP | 0441354 | 5/1996 |
| EP | 2220965 | 8/2010 |
| EP | 2292120 | 3/2011 |
| EP | 2732729 | 5/2014 |
| GB | 2291788 | 2/1996 |
| GB | 2297896 | 8/1996 |
| GB | 2325148 | 11/1998 |
| GB | 2359405 | 8/2001 |
| WO | 0024297 | 5/2000 |
| WO | 2005023060 | 3/2005 |
| WO | 2006067396 | 6/2006 |
| WO | 2008152973 | 12/2008 |
| WO | 2010024507 | 3/2010 |
| WO | 2012009822 | 1/2012 |
| WO | 2012015361 | 2/2012 |
| WO | 2012165191 | 12/2012 |

OTHER PUBLICATIONS

POS Tuning UDO Vobhenrich GMBH & Co. KG, POS-T Tuning LED Lighting of Trays, Sep. 9, 2010, 20 pp.
Streater, StreatLite Connector specifications page, Jun. 8, 2012, 1 p.
Trinity LLC, Trinity Credentials Presentation, Jul. 2013, 10 pp. (cover, title, 3, 13-18, 32).

* cited by examiner

ILLUMINATED SHELVING

CROSS-REFERENCE TO RELATED APPLICATIONS

This application is a continuation of prior U.S. application Ser. No. 13/415,138, filed Mar. 8, 2012, issued as U.S. Pat. No. 8,979,296 on Mar. 17, 2005, and claims the benefit of U.S. Provisional Application No. 61/450,420, filed Mar. 8, 2011, which are hereby incorporated herein by reference in their entirety.

FIELD OF THE INVENTION

The present invention relates generally to the field of display shelving. More particularly, the present invention relates to a shelving system that incorporates low voltage light fixtures attached to one or more shelves.

BACKGROUND OF THE INVENTION

In the retail environment, it is common for merchandise to be displayed on a series of adjustable shelves. Retail display shelving falls into two basic categories: (1) cases where shelves are supported by pins inserted into holes on each side of the case or (2) wall displays where a number of vertically oriented, slotted standards are attached to a wall and brackets having hooks designed to engage the slots support the shelves.

It is desirable to present the merchandise displayed on the shelves in a way that is attractive and easily visible to a potential customer. One way to increase the visibility of merchandise is to provide adequate lighting. In many retail environments, the primary source of lighting is provided by ceiling mounted fixtures. Specific products may also be highlighted or accented through the use of spot lights. When non-illuminated shelving is used, the upper shelves cast shadows that result in less than optimal lighting for the lower shelves.

There have been previous attempts to create shelving systems with integrated lighting, but those solutions present a number of shortcomings that the present invention seeks to address. Many such shelving systems essentially mounted existing light fixtures to the bottoms of already existing shelves. Such a solution presented the problem that each light fixture had a conventional plug that needed to be plugged into an outlet. For a system with fixed shelves, or shelves with a limited range of adjustment, the power cords could be relatively easily hidden. If the shelving has a broader range of adjustment, it is necessary to provide excess power cord, which is more difficult to hide.

As such, there is a need for a retail shelving system that incorporates lighting into the shelves such that the shelves may be quickly, easily, and safely reconfigured.

SUMMARY OF THE INVENTION

The present invention relates to an illuminated shelving system with integrated lighting for displaying items. The illuminated shelving system includes at least one shelf that is removably attached to a shelf support that supports the shelf in a horizontal position. The shelf support further includes a power strip to which the plug is removably attached and which provides electrical power to the light bar. At least one light bar is attached to at least one of the shelves and includes a power cable. An electrical plug is attached to the free end of the power cable. Each shelf includes a channel that encloses the power cable.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Figure 1:
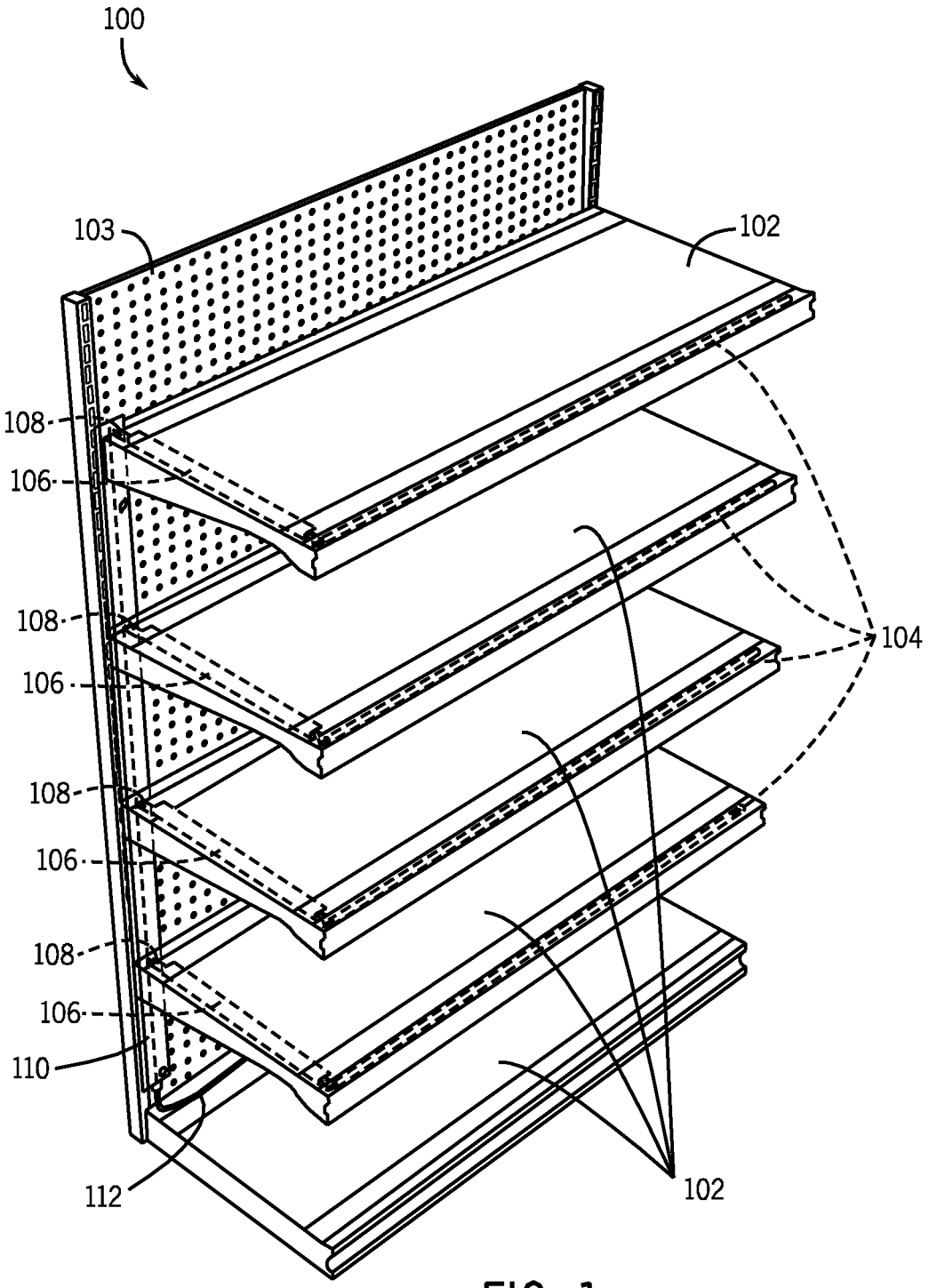
FIG. 1 is a front perspective view of one embodiment of an illuminated shelving system in accordance with the invention.

FIG. 1 is a perspective view of one embodiment of an illuminated shelving system in accordance with the invention. The shelving system 100 includes shelves 102 attached to a shelf support 103, light strips 104, light strip power cords 105, cord channels 106, and plugs 108 that connect to a power strip 110 that, in turn, is connected to a power source by a power cord 112. As shown, the shelves 102 are removably attached to the shelf support 103 and may be adjusted as required by the retailer to provide the proper spacing for displaying products. The light strips 104 are array of light emitting diodes (LED), but other lighting technologies such as halogen, fluorescent, or incandescent lamps may also be used without departing from the present invention. The light strips 104 may provide continuous brightness across the light strip, or may be configured to illuminate only certain portions of the shelf. Such a configuration allows the light strips 104 to provide accent lighting if so desired.

The light strips 104 are removably attached to the bottom surface of as many of the shelves 102 as is desired. The light strips 104 may be attached to the shelf 102 by adhesive, hook and loop fastener, bracket, or other attachment means. Each light strip 104 may be removably attached to the power strip 110.

Figure 2:
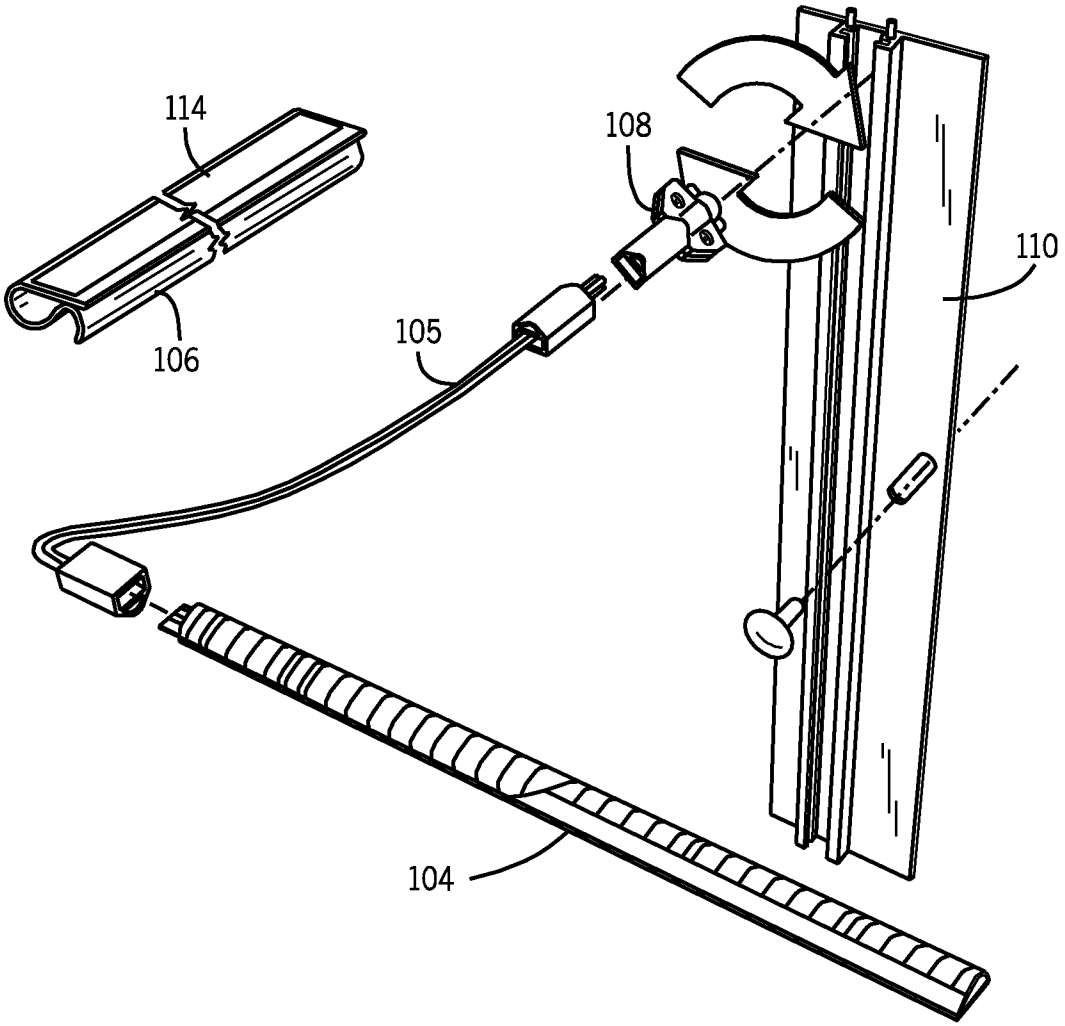
FIG. 2 is a perspective view of the illumination components of the shelving system of FIG. 1.
Figure 3:
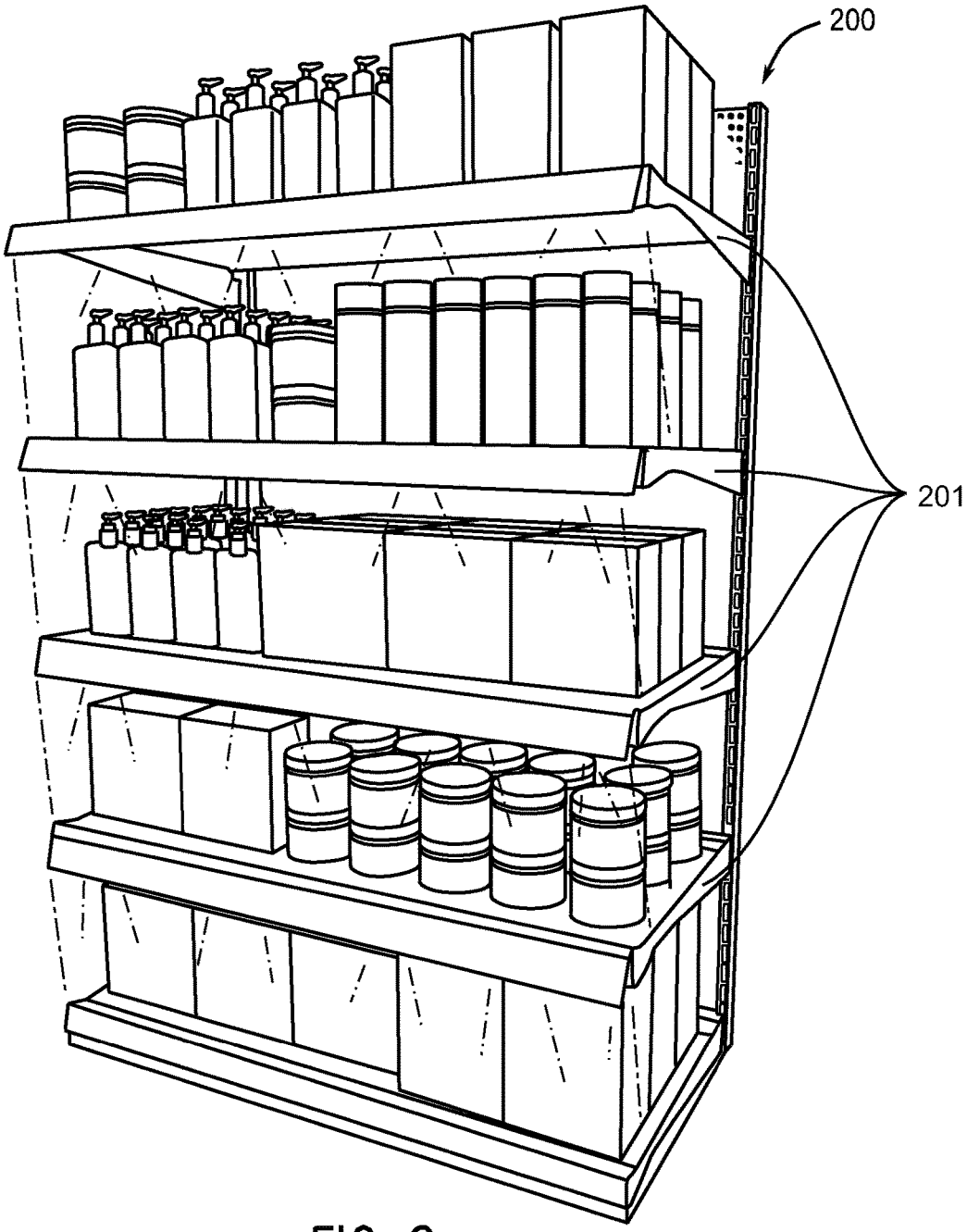
FIG. 3 is a perspective view of another embodiment of an illuminated shelving system in accordance with the invention.
Figure 4:
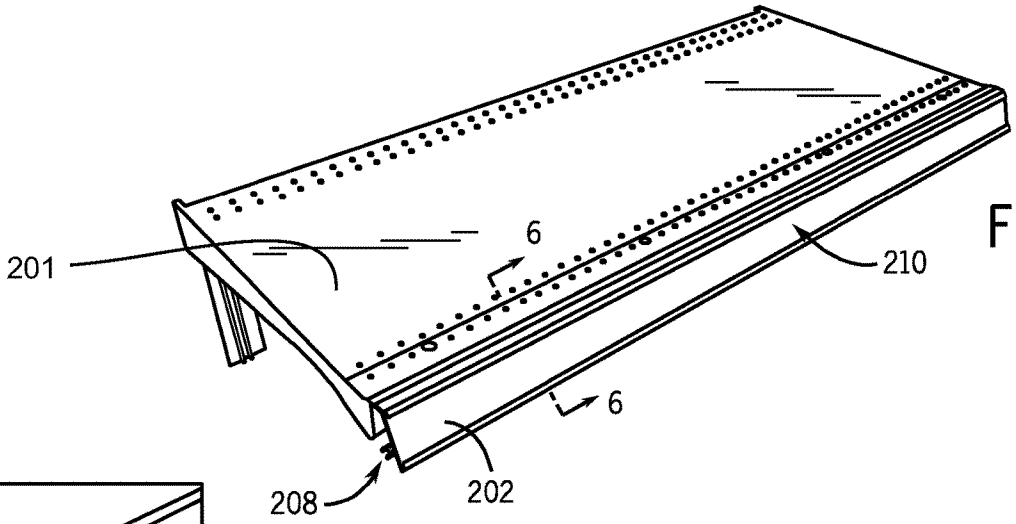
FIG. 4 is a perspective view of a shelf of the shelving system of FIG. 3.
Figure 6:
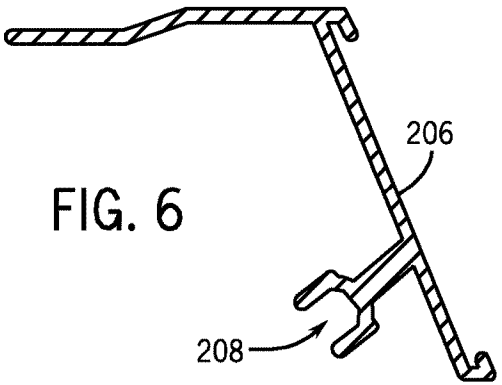
FIG. 6 is a section view of a lamp bracket in accordance with the shelving system of FIG. 3, taken generally along the line 6-6 in FIG. 4.
Figure 5:
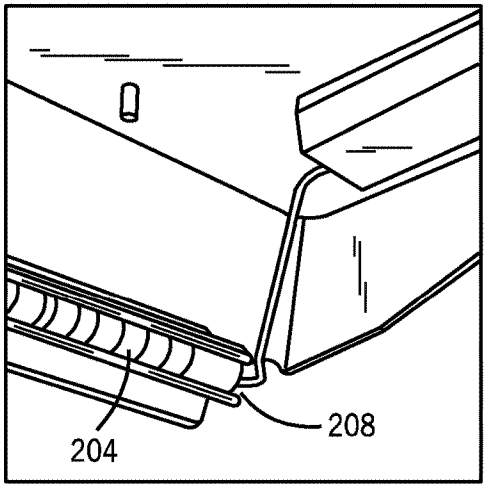
FIG. 5 is a detail perspective view of the shelf of FIG. 4, showing the underside detail of the shelf.

FIG. 2 is another perspective view of the illuminated shelving system of FIG. 1. FIG. 2 shows in greater detail how the lighting components themselves are interconnected. A light strip 104 is connected to a power strip 110 by a light strip power cord 105 and a plug 108. As shown, the shelving system 100 includes a low voltage lighting system incorporating Light Emitting Diode ("LED") lighting elements, including the power strip 110, which is a low voltage power strip such that individual plugs are not necessary. Of course, other power strips may be used without departing from the invention. The power cord 105 and plug 108 may be separate components as shown in FIG. 2, or may be created as a single component.

As shown, the power strip 110 is a continuous channel that provides much greater flexibility in terms of where the plug 108 is connected to the power strip 110 than a conventional electrical socket. Such flexibility allows the retailer to position the shelves 102 as desired without concern for where the plug 108 may be connected to the power strip 110. The plug 108 shown in the present embodiment is a "Twist and Lock" type, but other types may be used without departing from the invention. A cable channel 106 that guides the light strip power cord 105 from the light strip 104 to the power strip 110 is attached to the underside of each shelf 102 by double sided tape 114. Other fastening means may also be used without departing from the invention.

FIGS. 3-6 are perspective views of another embodiment of an illuminated shelving system 200 in accordance with the invention. Electrically, the embodiment illustrated in FIGS. 1-2 and the present embodiment are identical. Rather than attaching the light bar 104 directly to the underside of each shelf 102, however, the embodiment illustrated in FIGS. 3-6 includes a bracket 202 that is attached to the front edge of an existing shelf 201. The bracket 202 includes mounts 208 for attaching the light strip 204, which is electrically attached to a power strip 210. The bracket 202 may be made of extruded plastic that allows some of the light to illuminate price labels attached to the front of the bracket 206.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A shelving system comprising:

a power strip having first and second conductors arranged near one another on or in the power strip and running a longitudinal length of the power strip, the conductors forming a low voltage continuous power channel of uninterrupted length;

a connector for electrically connecting an electrically powered device to the continuous power channel at any position of the uninterrupted length of the power channel, wherein the connector is configured to form a detachable electrical connection with the electrically powered device, wherein the power strip defines first and second cavities running a longitudinal length of the power strip, with the first conductor being disposed in the first cavity and the second conductor being disposed in the second cavity and the cavities retaining the conductors in parallel alignment with one another, wherein the power strip has a generally flat portion with protrusions extending therefrom, the protrusions having general C-shaped structures defining inner openings, the inner openings forming the first and second cavities and being shaped to receive respective conductors, with the C-shaped protrusions shielding at least a portion of the conductors from exterior surroundings.

2. The shelving system of claim 1 wherein the power strip has an overall length and the conductors run a majority of the overall length of the power strip.

3. The shelving system of claim 2 wherein the conductors run a length approximately equal to the overall length of the power strip.

4. The shelving system of claim 1 wherein the power strip has a power cord extending therefrom for connecting the power strip to a power source.

5. An illuminated system for shelving comprising:

a power strip having first and second conductors arranged near one another on or in the power strip and running a longitudinal length of the power strip, the conductors forming a low voltage continuous power channel of uninterrupted length;

a light assembly having a light strip and a connector for electrically connecting the light assembly to the continuous power channel at any position of the uninterrupted length of the power channel so that the light assembly may be positioned as desired on the continuous power channel, wherein the light strip is configured to form a detachable electrical connection with the connector, wherein the power strip defines first and second cavities running a longitudinal length of the power strip, with the first conductor being disposed in the first cavity and the second conductor being disposed in the second cavity and the cavities retaining the conductors in parallel alignment with one another, and wherein the power strip has a generally flat portion with protrusions extending therefrom, the protrusions having general C-shaped structures defining inner openings, the inner openings forming the first and second cavities and being shaped to receive respective conductors, with the C-shaped protrusions shielding at least a portion of the conductors from exterior surroundings.

6. The illuminated system of claim 5 wherein the power strip has an overall length and the conductors run a majority of the overall length of the power strip.

7. The illuminated system of claim 6 wherein the conductors run a length approximately equal to the overall length of the power strip.

8. The illuminated system of claim 5 wherein the power strip has a power cord extending therefrom for connecting the power strip to a power source.

9. The illuminated system of claim 5 wherein the light assembly comprises a plurality of light assemblies each having a connector for electrically connecting a respective light assembly to the continuous power channel at any position of the uninterrupted length of the power channel so that the respective light assembly may be positioned as desired on the continuous power channel.

10. The illuminated system of claim 9 further comprising shelving to which at least one of the power strip and plurality of light assemblies are connected.

11. The illuminated system of claim 10 wherein the shelving comprises a vertical upright shelf support with individual shelves suspended from the shelf support, the light assemblies positioned to illuminate the individual shelves and the power strip being coupled to the shelf support via a fastener.

12. The illuminated system of claim 11 wherein the individual shelves have an upper surface for supporting product to be displayed on the shelving and the light assemblies are positioned to illuminate each upper surface of the shelves so as to illuminate product supported on the individual shelves.

13. The illuminated system of claim 5, wherein each of the light strip and the connector have corresponding male and female electrical mating components whereby the male component is configured to plug into the female component to form the detachable electrical connection.

14. The illuminated system of claim 5, further comprising a cable channel configured to attach to an underside of a shelf of the illuminated shelving system, wherein the cable channel guides a power cord from the light strip to the power strip.

15. The illuminated system of claim 5, wherein the light assembly further comprises a power cord that is detachably connectable to the connector, the power cord having either a male or female electrical mating component and the connector having a corresponding male or female electrical mating component so that one of the corresponding mating components plug into the another to form a detachable electrical connection.

16. The illuminated system of claim 5, wherein the light assembly further comprises a power cord that is detachably connectable to the light strip, the power cord having either a male or female electrical mating component and the light strip having a corresponding male or female electrical mating component so that one of the corresponding mating components can plug into the another to form a detachable electrical connection.

17. The illuminated system of claim 5, wherein the light assembly further comprises an intermediate power cord that is detachably connectable to both the connector and the light strip.

18. The illuminated system of claim 17, wherein the intermediate power cord comprises two opposing ends, wherein a first opposing end includes either a male or female first electrical mating component and the light strip includes a corresponding male or female first electrical mating component so that one of the corresponding first electrical mating components can plug into the other to form a detachable electrical connection, and wherein the second opposing end includes either a male or female second electrical mating component and the connector includes a corresponding male or female second electrical mating component so that one of the corresponding second electrical mating components can plug into the other to form a detachable electrical connection.

19. An illuminated system for shelving comprising:

a power strip having first and second conductors arranged near one another on or in the power strip and running a longitudinal length of the power strip, the conductors forming a low voltage continuous power channel of uninterrupted length;

a light assembly having a light strip and a connector for electrically connecting the light assembly to the continuous power channel at any position of the uninterrupted length of the power channel so that the light assembly may be positioned as desired on the continuous power channel, wherein the light strip is configured to form a detachable electrical connection with the connector, and wherein the light assembly further comprises an intermediate power cord that is detachably connectable to both the connector and the light strip.

20. The illuminated system of claim 19 wherein the power strip has an overall length and the conductors run a majority of the overall length of the power strip.

21. The illuminated system of claim 20 wherein the conductors run a length approximately equal to the overall length of the power strip.

22. The illuminated system of claim 19, wherein the power strip defines first and second cavities running a longitudinal length of the power strip, with the first conductor being disposed in the first cavity and the second conductor being disposed in the second cavity and the cavities retaining the conductors in parallel alignment with one another.

23. The illuminated system of claim 22, wherein the power strip has a generally flat portion with protrusions extending therefrom, the protrusions having general C-shaped structures defining inner openings, the inner openings forming the first and second cavities and being shaped to receive respective conductors, with the C-shaped protrusions shielding at least a portion of the conductors from exterior surroundings.

24. The illuminated system of claim 19 wherein the power strip has a power cord extending therefrom for connecting the power strip to a power source.

25. The illuminated system of claim 19 wherein the light assembly comprises a plurality of light assemblies each having a connector for electrically connecting a respective light assembly to the continuous power channel at any position of the uninterrupted length of the power channel so that the respective light assembly may be positioned as desired on the continuous power channel.

26. The illuminated system of claim 25 further comprising shelving to which at least one of the power strip and plurality of light assemblies are connected.

27. The illuminated system of claim 26 wherein the shelving comprises a vertical upright shelf support with individual shelves suspended from the shelf support, the light assemblies positioned to illuminate the individual shelves and the power strip being coupled to the shelf support via a fastener.

28. The illuminated system of claim 26 wherein the individual shelves have an upper surface for supporting product to be displayed on the shelving and the light assemblies are positioned to illuminate each upper surface of the shelves so as to illuminate product supported on the individual shelves.

29. The illuminated system of claim 19, wherein each of the light strip and the connector have corresponding male and female electrical mating components whereby the male component is configured to plug into the female component to form the detachable electrical connection.

30. The illuminated system of claim 19, further comprising a cable channel configured to attach to an underside of a shelf of the illuminated shelving system, wherein the cable channel guides a power cord from the light strip to the power strip.

31. The illuminated system of claim 19, wherein the light assembly further comprises a power cord that is detachably connectable to the connector, the power cord having either a male or female electrical mating component and the connector having a corresponding male or female electrical mating component so that one of the corresponding mating components plug into the another to form a detachable electrical connection.

32. The illuminated system of claim 19, wherein the light assembly further comprises a power cord that is detachably connectable to the light strip, the power cord having either a male or female electrical mating component and the light strip having a corresponding male or female electrical mating component so that one of the corresponding mating components can plug into the another to form a detachable electrical connection.

33. The illuminated system of claim 19, wherein the intermediate power cord comprises two opposing ends, wherein a first opposing end includes either a male or female first electrical mating component and the light strip includes a corresponding male or female first electrical mating component so that one of the corresponding first electrical mating components can plug into the other to form a detachable electrical connection, and wherein the second opposing end includes either a male or female second electrical mating component and the connector includes a corresponding male or female second electrical mating component so that one of the corresponding second electrical mating components can plug into the other to form a detachable electrical connection.

* * * * *